US010619830B1

(12) United States Patent
He

(10) Patent No.: US 10,619,830 B1
(45) Date of Patent: Apr. 14, 2020

(54) WICK LAMP AND ILLUMINATING LAMP SET

(71) Applicant: Shangyou Jiayi Lighting Product Co., Ltd., Jiangxi (CN)

(72) Inventor: Yaowen He, Ganzhou (CN)

(73) Assignee: Shangyou Jiayi Lighting Product Co., Ltd., Jiangxi (CN)

( * ) Notice: Subject to any disclaimer, the term of this patent is extended or adjusted under 35 U.S.C. 154(b) by 0 days.

(21) Appl. No.: 16/585,745

(22) Filed: Sep. 27, 2019

(30) Foreign Application Priority Data

Dec. 27, 2018 (CN) ..... 2018 2 222893

(51) Int. Cl.

| | |
|---|---|
| ***F21V 19/00*** | (2006.01) |
| ***F21K 9/90*** | (2016.01) |
| *F21Y 107/70* | (2016.01) |
| *F21Y 115/10* | (2016.01) |

(52) U.S. Cl.
CPC ..... *F21V 19/0025* (2013.01); *F21K 9/90* (2013.01); *F21Y 2107/70* (2016.08); *F21Y 2115/10* (2016.08)

(58) Field of Classification Search
CPC .... F21V 19/0025; F21K 9/90; F21Y 2107/70; F21Y 2115/10
See application file for complete search history.

(56) References Cited

U.S. PATENT DOCUMENTS

2003/0063463 A1* 4/2003 Sloan ..... F21V 21/0808 362/238
2008/0084009 A1* 4/2008 Derose ..... B29C 39/10 264/402
2017/0108185 A1* 4/2017 He ..... F21S 4/10

* cited by examiner

*Primary Examiner* — David V Bruce
(74) *Attorney, Agent, or Firm* — DLA Piper LLP (US)

(57) ABSTRACT

The present disclosure relates to the technical field of lamp bulbs, and in particular to a wick lamp and an illuminating lamp set. The wick lamp includes a lamp body, wherein a lamp rail that can be bent into different shapes is disposed inside the lamp body, and the lamp rail includes an insulating layer, two parallelly arranged conducting wires, and a plurality of LED light emitters; and the two parallelly arranged conducting wires are both outerly enclosed by the insulating layer, and the insulating layer is polished to form a welding region to which the LED light emitters are welded. The illuminating lamp set includes the wick lamp described above. The present disclosure enables omnidirectional light emission.

20 Claims, 2 Drawing Sheets

WICK LAMP AND ILLUMINATING LAMP SET

CROSS-REFERENCE TO RELATED APPLICATIONS

The present disclosure claims priority to Chinese Utility Model Patent Application No. 201822222893.0, filed with the Chinese Patent Office on Dec. 27, 2018, entitled "Wick Lamp and Illuminating Lamp Set", which is incorporated herein by reference in its entirety.

TECHNICAL FIELD

The present disclosure relates to the technical field of lamp bulbs, and in particular to a wick lamp and an illuminating lamp set.

BACKGROUND ART

With the advent of LED white light, a second revolution is started in the lighting industry. As a light source, the LED is not only energy-saving and environmentally-friendly, but also has a long service life, and falls within the environmentally-friendly, energy-saving and low-carbon products promoted by the state. The cost of LED lamps is reduced with the continuous improvement of LED technology, and energy-saving lamps and incandescent lamps will certainly be replaced by LED lamps. At present, the state is paying more and more attention to energy saving and environment protection issues in illumination, and the use of LED lamps has been vigorously promoted, and in particular, LED street lamps are considered as a first choice and the use of LED street lamps is designated in the governmental project of renovation of street lamps, thus it can be seen that there is a trend of replacing the energy-saving lamps and incandescent lamps with LED lamps. In today's situation where there is increasingly fierce price competition between ordinary LED lamps, intelligentization of LEDs has become the direction of development of LED lighting companies.

LED bulbs in the prior art, however, are usually equipped with a transition connector to place a power source, and therefore cannot be implemented with a full glass design. As a result, such LED filament bulbs are disliked by many customers or are not applicable to many places, especially to some places where illumination quality and effect are highly required.

Information disclosed in the Background Art section is only intended to facilitate understanding of the overall background art of the present disclosure, and shall not be deemed as admitting or implying in any form that the information constitutes the prior art well known to those skilled in the art.

SUMMARY

The present disclosure provides a wick lamp, and the wick lamp according to the present disclosure comprises a lamp body, wherein a lamp rail that can be bent into different shapes is disposed inside the lamp body, and the lamp rail comprises an insulating layer, two parallelly arranged conducting wires, and a plurality of LED light emitters; the two parallelly arranged conducting wires are both outerly enclosed by the insulating layer, and the insulating layer is polished to form a welding region to which the LED light emitters are welded.

The present disclosure provides an illuminating lamp set, and the illuminating lamp set according to the present disclosure comprises: the wick lamp described above.

BRIEF DESCRIPTION OF DRAWINGS

In order to more clearly illustrate technical solutions of specific embodiments of the present disclosure or of the prior art, drawings required for use in the description of specific embodiments or the prior art will be described briefly below. It is obvious that the drawings in the following description are merely illustrative of some embodiments of the present disclosure. It will be understood by those of ordinary skill in the art that other drawings can also be obtained from these drawings without any inventive effort.

REFERENCE NUMERALS

Figure 1:
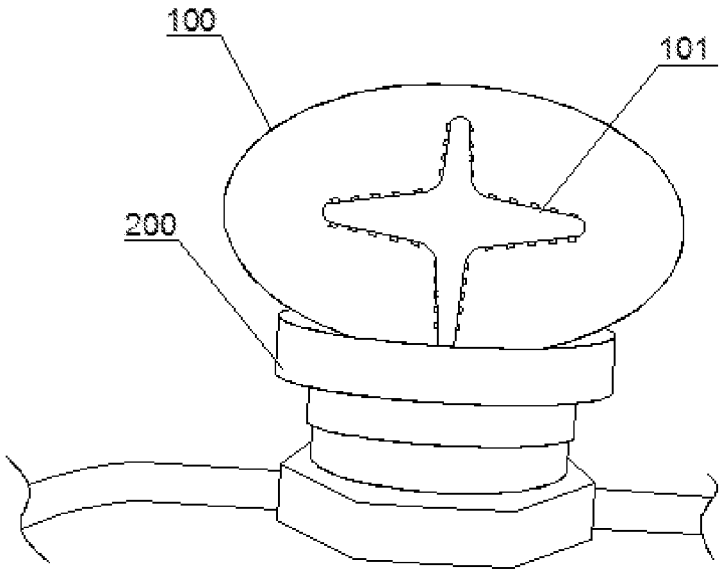
FIG. 1 is a schematic structural view of a wick lamp according to the present disclosure.

100—lamp body; 200—lamp holder; 101—lamp rail; 1011—LED light emitter; 1012—welding layer; 1013—conducting wire; 1014—insulating layer; 1015—conductive layer.

DETAILED DESCRIPTION OF EMBODIMENTS

The technical solutions of the present disclosure will be described below clearly and completely with reference to the drawings. It is apparent that the embodiments to be described are some, but not all of the embodiments of the present disclosure. All the other embodiments obtained by those of ordinary skill in the art in light of the embodiments of the present disclosure without inventive effort will fall within the scope of the present disclosure as claimed.

In the description of the present disclosure, it should be noted that orientation or positional relationships indicated by the terms such as "center", "up", "down", "left", "right", "vertical", "horizontal", "inside", and "outside" are the orientation or positional relationships shown based on the drawings, and these terms are intended only to facilitate the description of the present disclosure and simplify the description, but not intended to indicate or imply that the referred devices or elements must be in a particular orientation or constructed or operated in the particular orientation, and therefore should not be construed as limiting the present disclosure. In addition, the terms "first" and "second" are used for descriptive purpose only, and should not be understood as an indication or implication of relative importance.

In the description of the present disclosure, it should be noted that the terms "mount", "couple", and "connect" should be understood broadly unless otherwise expressly specified or defined. For example, connection may be fixed connection or detachable connection or integral connection, may be mechanical connection or electric connection, or may be direct coupling or indirect coupling via an intermediate medium or internal communication between two elements. The specific meanings of the above-mentioned terms in the present disclosure can be understood by those of ordinary skill in the art according to specific situations.

The present disclosure provides a wick lamp, capable of emitting light omnidirectionally.

The wick lamp according to the present disclosure comprises a lamp body, wherein a lamp rail that can be bent into different shapes is disposed inside the lamp body, and the lamp rail comprises an insulating layer, two parallelly arranged conducting wires, and a plurality of LED light emitters;

the two parallelly arranged conducting wires are both outerly enclosed by the insulating layer, and the insulating layer is polished to form a welding region to which the LED light emitters are welded.

Optionally, the LED light emitters are welded on the same side of the two conducting wires arranged in parallel, and a welding layer is disposed between the LED light emitter and the conducting wire.

Optionally, a positive terminal of the LED light emitter is electrically connected to one of the conducting wires, and a negative terminal of the LED light emitter is electrically connected to the other one of the conducting wires.

Optionally, a conductive layer is further disposed at the bottom of the LED light emitter, and the conductive layer is located between the lamp body and the welding layer.

Optionally, a colloid layer is disposed outside the LED light emitter.

Optionally, the welding layer includes a solder layer.

Optionally, a spacing between the two adjacent LED light emitters is 0.2 cm to 0.4 cm.

Optionally, the spacing between the two adjacent LED light emitters is 0.3 cm.

Optionally, the conducting wire is a copper wire.

Optionally, an insulating coating is provided both at a gap formed between the LED light emitter and the insulating layer and at an outer portion of the conductive layer exposed to the outside.

Optionally, a protective layer is disposed outside the colloid layer.

Optionally, the protective layer is a transparent protective layer.

Optionally, the colloid layer is solidified by baking.

Optionally, an outer surface of the LED light emitter is not provided with a colloid layer.

Optionally, the wick lamp further comprises a lamp holder, through which the lamp rail is connected to a power source.

The present disclosure provides an illuminating lamp set, capable of emitting light omnidirectionally.

The illuminating lamp set according to the present disclosure comprises: the wick lamp described above.

The present disclosure will be described in further detail below by way of specific embodiments and with reference to the drawings.

Figure 2:
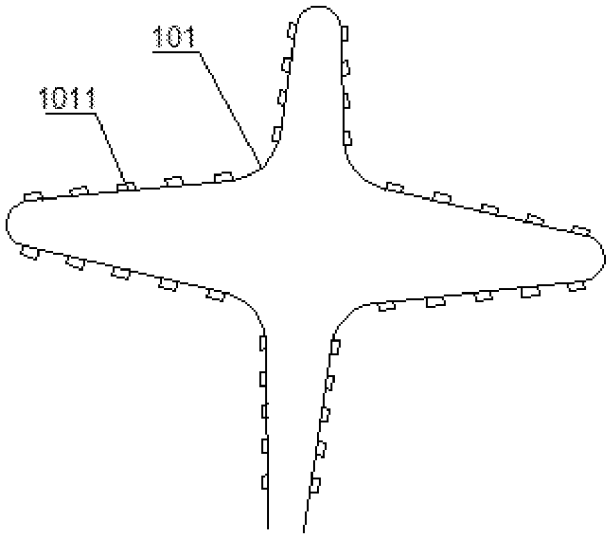
FIG. 2 is a schematic structural view of a lamp rail of a wick lamp according to the present disclosure.
Figure 3:
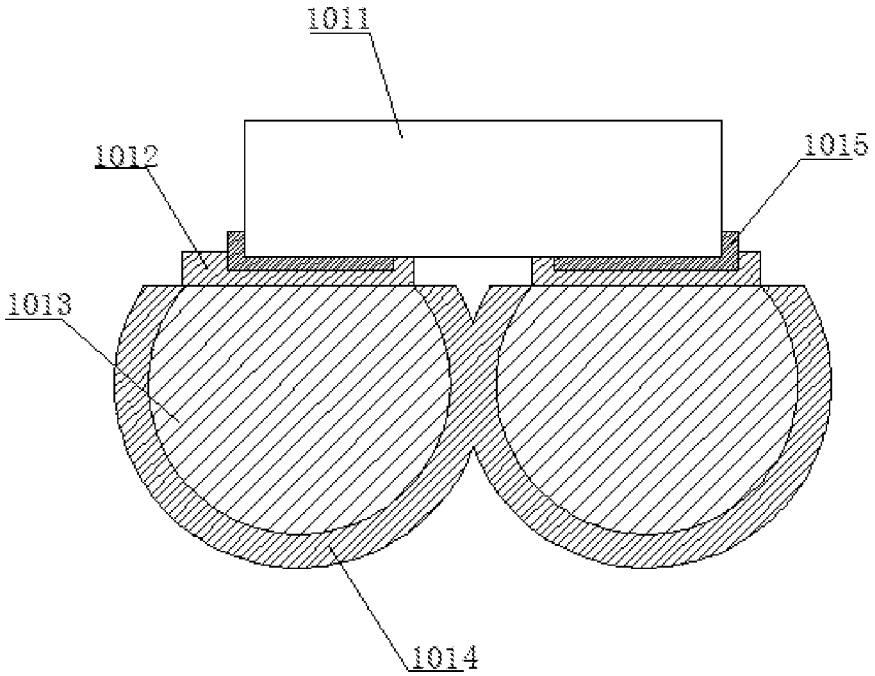
FIG. 3 is a cross-sectional view of a lamp rail of a wick lamp according to the present disclosure.

As shown in FIGS. 1 to 3, a wick lamp according to the present disclosure comprises a lamp body 100, a lamp rail 101 that can be bent into different shapes is disposed inside the lamp body 100, and the lamp rail 101 comprises an insulating layer 1014, two parallelly arranged conducting wires 1013, and a plurality of LED light emitters 1011; the two parallelly arranged conducting wires 1013 are both outerly enclosed by the insulating layer 1014, and the insulating layer 1014 is polished to form a welding region to which the LED light emitters 1011 are welded. With the arrangement of the plurality of LED light emitters 1011, the wick lamp achieves light emission over 360°, so that the light from light source can be diffused in all directions and can be emitted omnidirectionally.

Here, the LED light emitter 1011 is provided with the advantages of safety, high luminous efficiency, good shock resistance, and good stability; and moreover, the LED light emitter 1011 may emit colored light or a lamp body 100 capable of emitting light of multiple colors may be provided; thus it is unnecessary to coat an outer surface of the LED light emitter 1011 with a colored colloid layer, which has the advantage of saving raw materials.

In an optional solution of the present disclosure, the LED light emitters 1011 are welded on the same side of the two conducting wires 1013 arranged in parallel, and a welding layer 1012 is disposed between the LED light emitter 1011 and the conducting wire 1013; and the LED light emitters 1011 can be used to achieve light emission over 360°, so that light from the light source can be diffused in all directions.

Here, the welding layer 1012 includes a solder layer.

In an optional solution of the present disclosure, a positive terminal of the LED light emitter 1011 is electrically connected to one of the conducting wires 1013, and a negative terminal of the LED light emitter 1011 is electrically connected to the other one of the conducting wires 1013; and thereby the LED light emitter 1011 is enabled to illuminate.

Here, the conducting wire 1013 is provided as a copper wire, which can be used for electrical conduction, and can also be conveniently bent into different shapes.

In an optional solution of the present disclosure, a conductive layer 1015 is further disposed at the bottom of the LED light emitter 1011, and the conductive layer 1015 is located between the lamp body 100 and the welding layer 1012.

Here, an insulating coating is provided both at a gap formed between the LED light emitter 1011 and the insulating layer 1014 and at an outer portion of the conductive layer 1015 exposed to the outside, so that electric leakage can be avoided.

In an optional solution of the present disclosure, a colloid layer is disposed outside the LED light emitter 1011; and the colloid layer can enclose the LED light emitter 1011, and the colloid layer is solidified by baking.

It should be noted that a protective layer is disposed outside the colloid layer to serve the function of protecting the colloid layer and the LED light emitter 1011; and the protective layer is provided as a transparent protective layer, and light emission from the LED light emitter 1011 will not be affected by the arrangement of the transparent protective layer.

In an optional solution of the present disclosure, a spacing between the two adjacent LED light emitters 1011 is 0.2 cm to 0.4 cm.

Further, the spacing between the two adjacent LED light emitters 1011 is 0.3 cm, so that the wick lamp is formed as a short-interval wick lamp.

In an optional solution of the present disclosure, the wick lamp further comprises a lamp holder 200, and the lamp rail 101 is connected to a power source through the lamp holder 200, wherein no LED light emitter 1011 is disposed on the lamp rail 101 located outside the lamp body 100.

As can be seen from the above detailed description of the present disclosure, the wick lamp according to the present disclosure comprises a lamp body 100, a lamp rail 101 that can be bent into different shapes is disposed inside the lamp body 100, and the lamp rail 101 comprises an insulating layer 1014, two parallelly arranged conducting wires 1013, and a plurality of LED light emitters 1011; the two parallelly arranged conducting wires 1013 are both outerly enclosed by the insulating layer 1014, and the insulating layer 1014 is polished to form a welding region to which the LED light emitters 1011 are welded. In use, since the lamp rail 101 bent into different shapes is located in the lamp body 100, and the plurality of LED light emitters 1011 are welded on the lamp rail 101, light emission over 360° can be achieved, so that light from the light source can be diffused in all directions; and light can be emitted over a wider angle and the light can be diffused over a wider range.

An illuminating lamp set according to the present disclosure comprises: the wick lamp described above.

The illuminating lamp set according to the present disclosure comprises the wick lamp described above. Due to the arrangement of the wick lamp, the illuminating lamp set has all the advantages of the wick lamp described above; since the lamp rail can be bent into different shapes in the lamp body and a plurality of LED light emitters are welded on the lamp rail, light emission over 360° is achieved, and thereby omnidirectional light emission is enabled.

The wick lamp and the illuminating lamp set according to the present disclosure include the following advantages:

The wick lamp according to the present disclosure comprises a lamp body, a lamp rail that can be bent into different shapes is disposed inside the lamp body, and the lamp rail comprises an insulating layer, two parallelly arranged conducting wires, and a plurality of LED light emitters; the two parallelly arranged conducting wires are both outerly enclosed by the insulating layer, and the insulating layer is polished to form a welding region to which the LED light emitters are welded. In use, since the lamp rail bent into different shapes is located in the lamp body, and the plurality of LED light emitters are welded on the lamp rail, light emission over 360° can be achieved, so that light from the light source can be diffused in all directions; and light can be emitted over a wider angle and the light can be diffused over a wider range.

The illuminating lamp set according to the present disclosure comprises the wick lamp described above. Due to the arrangement of the wick lamp, the illuminating lamp set has all the advantages of the wick lamp described above; since the lamp rail can be bent into different shapes in the lamp body and a plurality of LED light emitters are welded on the lamp rail, light emission over 360° is achieved, and thereby omnidirectional light emission is enabled.

Finally, it should be noted that the above embodiments are merely intended to illustrate the technical solutions of the present disclosure, but not intended to limit the present disclosure. Although the present disclosure has been described in detail with reference to the foregoing embodiments, it should be understood by those of ordinary skill in the art that the technical solutions disclosed in the foregoing embodiments may still be modified, or some or all of the technical features thereof may be replaced with equivalents; and these modifications or replacements will not cause the essence of the corresponding technical solutions to depart from the scope of the technical solutions of the embodiments of the present disclosure.

In addition, it can be understood by those skilled in the art that while some embodiments described herein include some but not other features included in other embodiments, combinations of features of different embodiments are meant to be within the scope of the present disclosure and form different embodiments. For example, in the appended claims, any one of the claimed embodiments can be used in any combination. Information disclosed in the Background Art section is only intended to facilitate understanding of the overall background art of the present disclosure, and shall not be deemed as admitting or implying in any form that the information constitutes the prior art well known to those skilled in the art.

INDUSTRIAL APPLICABILITY

The wick lamp and the illuminating lamp set according to the present disclosure include the following advantages:

When the wick lamp according to the present disclosure is used, since the lamp rail bent into different shapes is located in the lamp body, and a plurality of LED light emitters are welded on the lamp rail, light emission over 360° can be achieved, so that light from the light source can be diffused in all directions; and light can be emitted over a wider angle and the light can be diffused over a wider range.

The illuminating lamp set according to the present disclosure comprises the wick lamp described above. Due to the arrangement of the wick lamp, the illuminating lamp set has all the advantages of the wick lamp described above; since the lamp rail can be bent into different shapes in the lamp body and a plurality of LED light emitters are welded on the lamp rail, light emission over 360° is achieved, and thereby omnidirectional light emission is enabled.

What is claimed is:

1. A wick lamp, comprising a lamp body, wherein a lamp rail that can be bent into different shapes is disposed inside the lamp body, and the lamp rail comprises an insulating layer, two parallelly arranged conducting wires, and a plurality of LED light emitters; and the two parallelly arranged conducting wires are both outerly enclosed by the insulating layer, and the insulating layer is polished to form a welding region to which the LED light emitters are welded.

2. The wick lamp according to claim 1, wherein the LED light emitters are welded on a same side of the two parallelly arranged conducting wires, and a welding layer is disposed between the LED light emitters and the conducting wires.

3. The wick lamp according to claim 1, wherein a positive terminal of each of the LED light emitters is electrically connected to one of the conducting wires, and a negative terminal of each of the LED light emitters is electrically connected to other one of the conducting wires.

4. The wick lamp according to claim 2, wherein a conductive layer is further disposed at a bottom of each of the LED light emitters, and the conductive layer is located between the lamp body and the welding layer.

5. The wick lamp according to claim 1, wherein each of the LED light emitters is provided with a colloid layer outside.

6. The wick lamp according to claim 2, wherein the welding layer includes a solder layer.

7. The wick lamp according to claim 1, wherein a spacing between two adjacent LED light emitters is 0.2 cm to 0.4 cm.

8. The wick lamp according to claim 7, wherein the spacing between the two adjacent LED light emitters is 0.3 cm.

9. The wick lamp according to claim 1, wherein the conducting wires are copper wires.

10. The wick lamp according to claim 4, wherein an insulating coating is provided both at a gap formed between the LED light emitters and the insulating layer and at an outer portion of the conductive layer exposed to outside.

11. The wick lamp according to claim 5, wherein a protective layer is disposed outside the colloid layer.

12. The wick lamp according to claim 11, wherein the protective layer is a transparent protective layer.

13. The wick lamp according to claim 5, wherein the colloid layer is solidified by baking.

14. The wick lamp according to claim 1, wherein an outer surface of each of the LED light emitters is not provided with a colloid layer.

15. The wick lamp according to claim 1, further comprising a lamp holder, through which the lamp rail is connected to a power source.

16. An illuminating lamp set, comprising: the wick lamp according to claim 1.

17. The illuminating lamp set according to claim 16, wherein the LED light emitters are welded on a same side of the two parallelly arranged conducting wires, and a welding layer is disposed between the LED light emitters and the conducting wires.

18. The illuminating lamp set according to claim 16, wherein a positive terminal of each of the LED light emitters is electrically connected to one of the conducting wires, and a negative terminal of each of the LED light emitters is electrically connected to other one of the conducting wires.

19. The illuminating lamp set according to claim 17, wherein a conductive layer is further disposed at a bottom of each of the LED light emitters, and the conductive layer is located between the lamp body and the welding layer.

20. The illuminating lamp set according to claim 16, wherein each of the LED light emitters is provided with a colloid layer outside.

* * * * *